United States Patent [19]

Spauschus

[11] 4,316,364

[45] Feb. 23, 1982

[54] VAPOR COMPRESSION REFRIGERANT SYSTEM MONITOR

[76] Inventor: Hans O. Spauschus, 4300 Greenhaven La., Prospect, Ky. 40059

[21] Appl. No.: 147,691

[22] Filed: May 7, 1980

[51] Int. Cl.[3] ..... G01K 13/00; F25B 43/04

[52] U.S. Cl. ..... 62/129; 62/85; 62/475

[58] Field of Search ..... 62/129, 85, 195, 475

[56] References Cited

U.S. PATENT DOCUMENTS 1,636,512 7/1927 Hilger ..... 62/85

3,838,578 10/1974 Sakasegawa et al. ..... 62/125

*Primary Examiner*—Albert J. Makay

*Assistant Examiner*—Harry B. Tanner

*Attorney, Agent, or Firm*—Francis H. Boos

[57] ABSTRACT

A monitor for a vapor compression refrigerant system that accumulates contaminant gases generated in an operating system and provides a readout indicative of the presence of significant amounts of contaminant gases which readout serves to provide an indication of an incipient malfunction of the refrigerant system. Embodiments are disclosed which provide selective accumulation and/or analysis of contaminant gases to provide an indication of both the existence and general nature of the incipient malfunction.

1 Claim, 5 Drawing Figures

VAPOR COMPRESSION REFRIGERANT SYSTEM MONITOR

BACKGROUND OF THE INVENTION

This invention relates to the monitoring of a vapor compression refrigerant system and more specifically to one or more embodiments of a monitor of the type which is adapted to detect and provide an indication of the onset of a system malfunction preferably in time to initiate corrective action before actual system breakdown occurs.

Refrigerant systems of the type which can advantageously employ the present invention are those used in air conditioners, heat pumps, commercial food refrigeration systems and the like, which employ a sealed refrigerant circuit comprised of a refrigerant compressor, a condenser, an evaporator and a fluid expansion device, such as an expansion valve or a capillary tube, connected between the condenser and the evaporator. Such systems may also include a filter-drier to remove particulate contaminants and to control the moisture content of the circulating refrigerant. Such systems may also include a receiver for controlling and metering the flow of liquid refrigerant from the condenser and an accumulator located upstream of the suction line leading to the compressor, the purpose of the receiver being to store excess liquid refrigerant in the system and to avoid influx of the liquid refrigerant to the compressor during start-up.

Systems of the type just described generally are operated with no provision for determining incipient malfunctions in the system, although a moisture indicator has been used in some installations. Typically, the refrigerant system is operated until system breakdown occurs at which time repair service is initiated to put the system back into operation. The down time that results from this kind of reactive maintenance program is, at best, an inconvenience for the system user and can often be very costly in terms of such things as food spoilage as in the case of commercial food refrigeration systems. It is, therefore, desirable to provide apparatus that will monitor the operation of the refrigerant system on an ongoing basis to provide an indication of the onset of a system malfunction and, where possible, to define the nature of the incipient malfunction, e.g. air leak, motor insulation deterioration, compressor malfunction, etc.

Prior publications by applicant and others have discussed the desirability of analyzing the existence and nature of contaminant gases in a refrigerant system of the type described. In one such article by applicant and Mr. R. S. Olsen entitled "Gas Analysis—a New Tool for Determining the Chemical Stability of Hermetic Systems" which was published in 1959 in Refrigeration Engineering Vol. 67, No. 2, pg. 25 et seg., the use of gas analysis was discussed as a tool for determining chemical stability of hermetic refrigerant systems and a variety of laboratory techniques were described for separating gas samples and performing the gas analysis on actual refrigerant system equipment. These sensitive and complex techniques, while suitable for laboratory purposes, are not well adapted for use on an ongoing basis under field operating conditions. Moreover, while the paper describes gas analysis as a technique for selecting suitable materials for use in designing refrigerant systems, it does not treat the use of gas analysis as a monitoring technique for field use to detect incipient systems malfunctions. In a later article entitled "Material Stabilities in Vapor Compression Refrigeration Systems" by applicant and co-authors and presented at the XIth International Congress of Refrigeration in Munich, West Germany, in 1963, there was provided a summary of gaseous contaminants formed by degradation of materials used in the construction of refrigeration systems. It was shown that materials produce characteristic gaseous products and that the rate of gas formation is an indication of the rate of degradation. As in the earlier paper, the objective of this work was to aid in selecting suitable materials for use in designing refrigerant systems. To applicant's knowledge, there is not presently available a suitable refrigerant system monitor employing techniques of contaminant gas collection and analysis as a means of detecting incipient system malfunction.

It is, therefore, an object of the invention to provide a monitor for a vapor compression refrigerant system adapted for in-situ indication of an incipient malfunction in the system.

It is a further object of the invention to provide apparatus of the type described which operates on the basis of analysis of contaminant gases in the refrigerant stream to monitor system condition.

It is a still further object of the invention to provide apparatus of the type described which is simple to construct and does not require highly skilled technicians in the field to operate or interpret.

It is yet a further object of the invention to provide monitor apparatus of the type described which provides an indication of both the existence and the nature of an incipient malfunction in the system.

SUMMARY OF THE INVENTION

Therefore, in accordance with the invention, there is provided condition monitoring apparatus for a vapor compression refrigerant system of the type having a refrigerant flow circuit including a compressor, a condenser, fluid expansion means, and an evaporator, wherein the monitor apparatus comprises means for intercepting and accumulating contaminant gases appearing in the refrigerant stream and further comprises means coupled to the gas accumulating means for providing indicia representative of the presence of contaminant gases accumulated therein so as to provide an in-situ indication of the onset of a system malfunction. In one aspect of the invention, the indicia is responsive to temperature of the accumulated gas to provide a thermal indication of the presence of contaminant gas while in another aspect of the invention, the gas is passed through one or more materials capable of changing a physical property such as color in response to the gas passed therethrough and a window is provided to enable visual observation of the color change so created. In still further aspects of the invention, the contaminant gases may be selectively accumulated in one or more chambers, as by means of perm-selective filters or a gas separation column, so that the type of gas accumulated can provide an indication of not only the existence but also the nature of the incipient malfunction.

DETAILED DESCRIPTION

Figure 1:
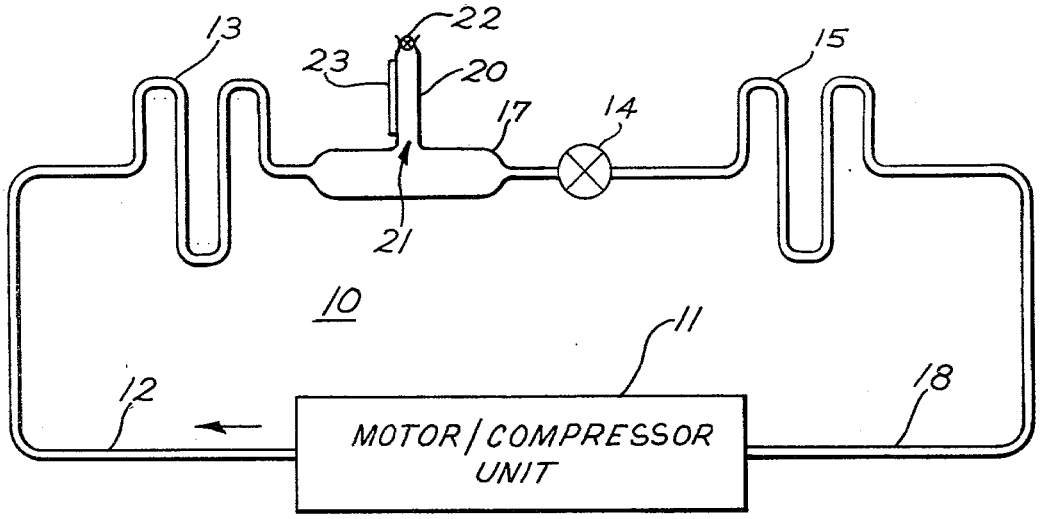
FIG. 1 is a schematic diagram of a representative refrigerant circuit illustrating one embodiment of monitor apparatus constructed in accordance with the present invention.

Referring to FIG. 1, a refrigerant circuit 10 is shown generally in schematic form as including hermetic motor compressor unit 11, condenser 13, and evaporator 15. Condenser 13 is connected on its inlet side to the high side of compressor 11 via connecting tubing 12 and on its outlet side via a device 17, such as a filter-drier or receiver, to fluid expansion means 14. Fluid expansion means 14 may take the form of a fluid expansion valve or a capillary tube and serves both as a fluid expansion and metering device in known manner. The fluid expansion device outlet is connected to the evaporator 15 and then through suction line 18 to the low side of the motor compressor unit 11. As previously explained, the filter-drier or receiver acts as a holding vessel for liquid refrigerant and may also provide a suitable space where non-condensable contaminant gases can collect. For the purpose of the following description, it will be assumed that device 17 is a receiver.

In accordance with one embodiment of the invention, as illustrated in FIG. 1, a gas accumulating chamber 20 is formed on the upper surface of liquid receiver 17 and is in open communication with the refrigerant stream flowing through receiver 17 via an inlet port 21. An outlet bleed valve 22 is provided to provide for a convenient means of discharging gas accumulated in chamber 20 when it is desired to do so. Further in accordance with the illustrated embodiment of the invention, means, such as a liquid crystal temperature indicator 23, is secured to the side of chamber 20 in good thermal communication therewith to provide indicia, such as in this case a temperature indication which is representative of the presence of contaminant gases in chamber 20. As will be explained, the presence of contaminant gases in chamber 20 as indicated by the temperature indication provides an in-situ indication of the onset of a refrigerant system malfunction which can be identified and repaired using routine service procedures prior to the occurrence of complete system breakdown or failure.

Vapor compression refrigerant systems, as is known, perform their heating or cooling function through liquifaction of a condensable refrigerant by means of a mechanical compressor. During the manufacturing process, systems are thoroughly evacuated to remove residual air and moisture, then helium leak tested and charged with the selected refrigerant. Following this, the system is permanently sealed to isolate the refrigeration unit from the outside atmosphere. It is well known that thorough elimination of residual gases is required to assure long and reliable operation of the system. It has also been established that very small amounts of new gaseous decomposition products will be generated inside the refrigerant system if the system, and particularly the motor compressor unit, is allowed to operate at conditions of high temperature or marginal lubrication. In most instances, these gaseous products are present at such low concentration (parts per million) relative to the refrigerant, that they do not interfere with the performance or reliability of the system. As operating conditions become more severe or marginal, however, larger quantities of gaseous products are produced and the system will ultimately become inoperable. Knowledge of the nature and amount of gaseous contaminants in a system, and the rate at which such contaminants are generated, can provide an early signal that a vapor compression system is not operating properly, i.e. an incipient malfunction is present. Analysis of the contaminant gases can provide an indication as to the nature of the problem that exists which can lead to appropriate corrective action and avoidance of catastrophic failure through complete system breakdown. Even when a complete gas analysis is not possible to determine the exact nature of the fault, the indication of the presence of contaminant gases nonetheless does serve as an early warning which provides an opportunity to replace a marginal motor compressor unit on a planned basis rather than on an emergency basis.

Referring again to the schematically illustrated system of FIG. 1, it will be assumed initially that evacuation of the system was not perfect and that consequently a small quantity (e.g. 100 standard cubic centimeters) of residual air remains in the unit, comingled with the refrigerant charge. When the system is put into operation, the liquid refrigerant circulates through the liquid receiver 17. As this occurs, the non-condensable contaminant air separates and collects in the gas accumulation chamber 20. Normally the liquid refrigerant circulating through receiver 17 will cause the receiver to be hot to the touch from heat of compression and liquifaction. However, gas collection chamber 20 which contains the non-condensable air will be relatively cool because the air is a poor thermal conductor. In fact, it may be shown that there exists a distinct temperature boundary determined by the quantity of air which is now compressed by the refrigerant gas pressure and collected in the gas accumulation chamber 20. The liquid crystal temperature sensor and readout device 23 attached to the side of chamber 20 then provides a visual readout of the quantity of non-condensable gas, which would be air in this initial example of use as an evacuation monitor, which readout is readily observed by the operator of the system.

Although there is flexibility allowed in the sizing of the chamber 20, a suitable approach to proper sizing begins with estimating the volume of non-condensable contaminant gases which are to be detected by the monitor of the invention. For this estimate, it may be assumed that the main body of chamber 20 has an internal diameter of, for example, 1 centimeter. In this event, the internal volume for each linear centimeter of height is $\frac{1}{4}$ $D^2 \times 1$ or about 0.8 cubic centimeters. Since the non-condensable gas is shown in FIG. 1 as being collected on the high pressure side of the refrigerant system, it will be compressed and its volume will be reduced in direct proportion to the high side pressure. Assuming the high side pressure to be 180 pounds per square inch, this would cause a volume reduction of about $180 \neq 14.7$ (atmospheric pressure) or by a factor of about 12. Thus each centimeter of height of the gas collection chamber 20 would contain $0.8 \times 12$ or about 9.6 standard cubic centimeters of non-condensable gas. A 20 cm collection chamber would then hold a total of about 192 standard cubic centimeters of non-condensable gas. The aforementioned article by applicant and R. S. Olsen indicated that an unstable combination of refrigerant and motor insulation could generate about 200 standard cubic centimeters of non-condensable gas in a period of 150 days. Thus the operator would have ample time to detect the incipient failure with a gas collection chamber of the size just described.

Very significant easily detectable temperature differences would exist at the boundary of the hot exhaust gas and the upper portion of the gas collection chamber containing trapped non-condensable gas. For refrigerant 12 systems, a condensing temperature of 130° F. (54.4° C.) is not uncommon and if the ambient air is 90° F. (32.2° C.), a temperature difference of 40° F. or 22° C. will exist across the boundary. As the contaminant gas volume increases, this boundary level as indicated by the temperature indicator 23 will move down the accumulator chamber 20.

Although the monitor embodiment is shown in FIG. 1 as being formed on the upper surface of receiver 17, other suitable locations are possible such as, for example, in the line connecting condenser 13 to device 17, it merely being preferred that the location selected being one which enables migration of the contaminant gas to the accumulator chamber 20.

While the foregoing monitor apparatus may be employed as described above to determine that the system is properly evacuated and sealed, it is also useful as a aging monitor to indicate the presence of contaminant gases which may collect over long periods of operation due to such things as deterioration of electrical insulation in the compressor motor. For example, after several years of operation, a motor may begin to develop local hot spots in the windings which result in the formation of small quantities of hydrogen and carbon monoxide. Since these gases are not condensable at the conditions, i.e. temperature and pressure, of normal refrigerant system operation, they will also collect in the chamber 20 and their presence will be signalled by the development of a temperature boundary which will shift downward in the gas collection chamber in direct response to the quantity of gas formed and collected. This indication may be used to perform a planned replacement of the motor compressor unit or if desired the gas may be bled off into a removable gas collection unit for analyzing by gas chromatography or mass spectrometry if it is desired to know the more precise nature of the incipient malfunction.

Figure 2:
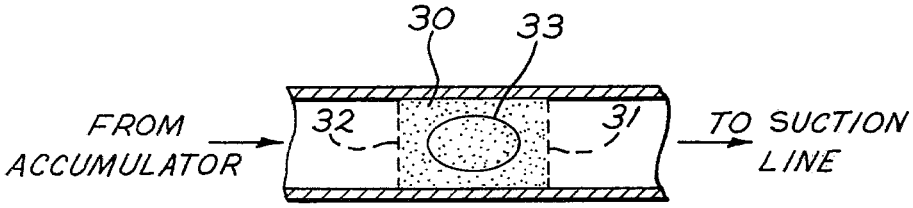
FIGS. 2–5 illustrate alternative embodiments of monitors constructed in accordance with the present invention.

Referring now to FIG. 2, an alternative embodiment of the invention is shown in which a gas indicator type of material is placed at a convenient location in the refrigerant circuit such as, for example, between the outlet of evaporator 15 and suction line 18. This material may be coated on the inner surface of the tubing or may be loosely packed and held in place by screens 31, 32. Materials which change color in response to specific gases are well known in the art. In order to provide a visual indication of the existence of contaminant gases as indicated by the color change, a window 33 is provided in the tubing aligned with the indicator material thus providing a convenient means for viewing the indicator material.

Figure 3:
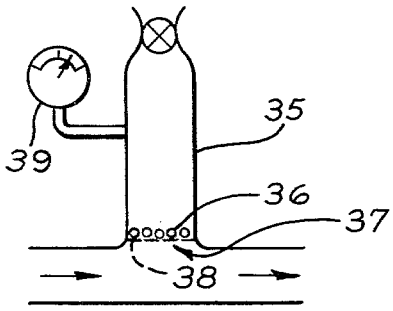

In FIG. 3, a gas collection chamber 35 similar to that of FIG. 1 is shown in which provision is made for selective accumulation of gas within chamber 35 by means of a perm-selective filter 36 interposed across the inlet port 37 and held in place by means of screen 38. As shown in FIG. 3, a pressure readout device 39 is shown to provide a pressure reading which serves to give information concerning the rate of contaminant gas buildup in the collection chamber. Thus, the rate of buildup of pressure is related to the amount of the contaminant gas in the circulating refrigerant and by virtue of the selective membrane, the nature of the contaminant gas or gases can generally be assumed. This in turn provides an indication not only of the existence but also the general nature of the incipient malfunction in the system.

Figure 4:
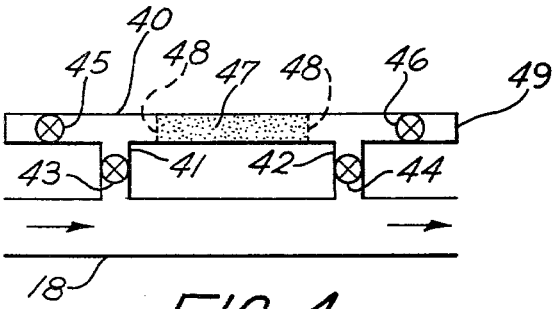

In FIG. 4, an alternative embodiment useful in collecting sufficient quantities of contaminant gas to enable reliable offline gas analysis is shown. In this version, a bypass tube 40 is connected to the refrigerant circuit tubing at an appropriate point such as in the suction line 18, by means of connecting tubes 41 and 42. During normal operation of the refrigerant system, connecting valves 43 and 44 are open while valves 45 and 46 are closed. Bypass line 40 is filled between inlet tubes 41, 42 with surface active material of suitable composition for adsorbing or absorbing selected contaminant gases. The surface active material 47 may be held in place by screens 48. During normal operation of the refrigerant system with valves 43 and 44 open and valves 45 and 46 closed, contaminant gases in the circulating refrigerant passing through line 40 are trapped and accumulated in material 47. When it is desired at appropriate times to perform tests to determine the existence of contaminant gases, valves 43 and 44 are closed and a source of elution gas such as argon or helium is connected to one end such as at end 49 to carry the contaminant gas out of the material to a gas collection device attached at the opposite end of bypass tube 40 for subsequent gas analysis.

Figure 5:
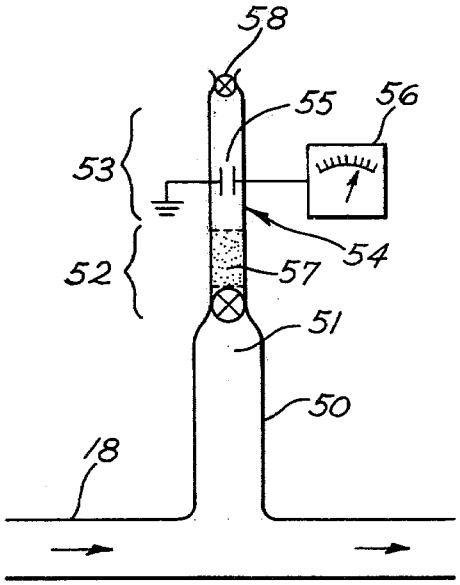

In high-cost commercial refrigerant systems, more sophisticated on-line analyzers may represent the preferred form of monitor apparatus in accordance with the invention. Referring to FIG. 5, such a system is shown schematically in which a contaminant gas collection chamber 50 is coupled to the refrigerant circuit tubing and is connected at its outlet end via a control valve 51 to an analysis tube or gas test column which includes an entry zone 52 having suitable gas selective material 57 therein which, when the valve 51 is opened, admits the accumulated contaminant gases into the gas test column 54 on a time spaced basis dependent on the nature of the contaminant gases collected in chamber 50. These gases are then passed into an upper zone 53 in which gas sensing electrodes 55 are provided. These electrodes are electrically connected to a suitable gas analysis equipment 56, which take the form of a gas chromatography system, to determine both the presence and nature of the contaminant gases. The gases which enter zone 53 may be bled off from the test column 54 as desired by means of a bleed valve 58.

It will be appreciated that there has been shown and described suitable apparatus of a relatively simple nature for continuous monitoring of refrigerant systems. As a consequence of this invention, it will be appreciated that the operator/owner of the refrigerant system can make informed decisions as to whether or not a serious reliability problem exists with the system as signalled by the presence of the non-condensable gases in the refrigerant system. With improved embodiments which provide for a form of gas analysis, the nature of the fault can be determined and the proper remedy employed, which can avoid costly and unnecessary service and replacement of major components that may actually be in good operating order.

In accordance with the patent statutes, there has been described what at present are considered to be the preferred embodiments of the invention. However, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. Condition monitoring apparatus for a vapor compression refrigerant system having a refrigerant flow circuit including a compressor, a condenser, fluid expansion means, and an evaporator, said monitoring apparatus comprising:

gas accumulating means including an elongated chamber positioned in the high pressure side of the refrigerant circuit at a high point to which non-condensable contaminant gases in the refrigerant stream migrate during operation of the system;

and means including an elongated temperature sensitive indicator in thermal communication with said gas accumulating means along a substantial portion of the length of said chamber whereby a depressed temperature indication relative to temperature of the condensed refrigerant stream at any of a plurality of points along the length of said indicator represents the degree of accumulation of non-condensable contaminant gases in the refrigerant stream thereby providing an in-situ indication of the onset of a system malfunction.

* * * * *

UNITED STATES PATENT AND TRADEMARK OFFICE

CERTIFICATE OF CORRECTION

PATENT NO. : 4,316,364

DATED : February 23, 1982

INVENTOR(S) : Hans O. Spauschus

It is certified that error appears in the above—identified patent and that said Letters Patent is hereby corrected as shown below:

Column 1, line 55, "seg." should read -- seq. --.

Column 4, line 55, "180≠14.7" should read -- 180±14.7 --.

Column 5, line 5, "12" (bold type) should read -- 12 --, (not in bold type).

Signed and Sealed this

*Eighth* Day of *June 1982*

[SEAL]

*Attest:*

GERALD J. MOSSINGHOFF

*Attesting Officer*

*Commissioner of Patents and Trademarks*